US006435907B1

(12) United States Patent
Ko

(10) Patent No.: US 6,435,907 B1
(45) Date of Patent: Aug. 20, 2002

(54) LOW PROFILE CABLE END CONNECTOR WITH EMI SHELL

(75) Inventor: David Tso-Chin Ko, Cypress, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/887,456

(22) Filed: Jun. 21, 2001

Related U.S. Application Data

(63) Continuation-in-part of application No. 09/709,226, filed on Nov. 8, 2000.

(51) Int. Cl.[7] ..... H01R 17/04
(52) U.S. Cl. ..... 439/585
(58) Field of Search ..... 439/578–585

(56) References Cited

U.S. PATENT DOCUMENTS 5,061,206 A * 10/1991 Kawanami et al. ..... 439/585
5,110,308 A * 5/1992 Nishikawa et al. ..... 439/585
5,263,877 A * 11/1993 Mitani ..... 439/585
5,569,049 A * 10/1996 Tatebe et al. ..... 439/585
5,603,636 A * 2/1997 Kanou et al. ..... 439/585
5,785,555 A * 7/1998 O'Sullivan et al. ..... 439/585
5,860,833 A * 1/1999 Chillscyzn et al. ..... 439/585

* cited by examiner

*Primary Examiner*—Gary F. Paumen
(74) *Attorney, Agent, or Firm*—Wei Te Chung

(57) ABSTRACT

A cable end connector includes a dielectric housing (10), a terminal (30) received in the housing, a shell (50) shielding the housing, and a retainer (60) attached to the shell for holding a coaxial cable (70) therein. The housing includes a tubular portion (20) and a base portion (40). The terminal has a mating portion (33), and a tail portion (31) perpendicular to the mating portion. The shell comprises a planar portion (53) supporting the housing, and a trunk portion (51) bendably connected to the planar portion and enclosing the tubular portion of the housing. The retainer has a braiding crimp (65) at an end thereof extending rearwardly beyond arms (513) of the trunk portion, for grounding a braiding layer (75) of the coaxial cable.

1 Claim, 9 Drawing Sheets

LOW PROFILE CABLE END CONNECTOR WITH EMI SHELL

CROSS-REFERENCE TO RELATED APPLICATIONS

This application is a continuation-in-part (CIP) application of co-pending patent application Ser. No. 09/709,226 filed Nov. 8, 2000 and entitled Cable End Connector Having Accurately Positioned Connection Terminal Therein, whose disclosure is incorporated herein by reference.

This application is a co-pending application of patent applications respectively entitled Low Profile Cable End Connector with Ser. No. 09/888,162 filed 06/21/01 and EMI Shell Used with Low Profile Cable End Connector Ser. No. 09/887,457 filed 06/21/01. The inventor in both such applications is the same as the inventor in the present application i.e. David Ko. Both such applications were filed on the same day as was the present application, and both such applications have the same assignee as in the present application.

BACKGROUND OF THE INVENTION

1. Field of the Invention

The present invention relates to a low profile cable end connector, and more particularly to a low profile cable end connector accurately positioning a terminal therein and reliably mating with a complementary connector.

2. Related Art

Cable end connectors are often used for transmitting radio-frequency (RF) signals. Cable end connectors normally have a terminal received in a housing thereof to mate with a complementary plug. A conventional cable end connector is disclosed in U.S. Pat. No. 5,263,877. The cable end connector includes a dielectric member holding a central terminal within an outer conductive shell. The central terminal has a U-shaped connection portion for connecting with a coaxial cable connector, and a coupling portion for mating with a complementary plug. As disclosed in this patent, in assembly, a tubular side wall of the dielectric member and a holder portion of the outer shell are bent substantially at a right angles to hold the connection portion of the terminal and an inner conductor of the coaxial cable within the dielectric member, and to crimp braiding of the coaxial cable to the outer shell of the connector.

The terminal is connected to the coaxial cable before assembly to the housing. Thus the terminal cannot be precisely positioned. Any misalignment between the coaxial cable and the housing adversely affects proper positioning of the terminal.

The parent application of this application provides an improved connector for accurately and firmly positioning the terminal. The cable end connector thereof comprises a dielectric housing, a terminal received in the housing, a unitarily formed shell, and a retainer attached to the shell for holding a coaxial cable therein. The housing includes a base portion and a tubular portion engaged with the base portion. The tubular portion axially defines a passageway therethrough. The terminal has a mating portion, and a tail portion perpendicular to the mating portion. The mating portion extends into the passageway for mating with a complementary connector. The tail portion is retained on the base portion for connecting with an inner conductor of the coaxial cable. The shell comprises a planar portion supporting the housing, and a tubular portion bendably connected to the planar portion and enclosing the tubular portion of the housing. A pair of arms extends rearwardly from the tubular portion. The arms and a portion of the retainer define a space for accommodating the tail portion of the terminal. The housing can be firmly fixed by the shell and the retainer to ensure accurate positioning of the terminal.

Although the cable end connector of the parent application can accurately and firmly position the terminal, the connector has a relatively high profile. Furthermore, the housing thereof occupies a relatively large space. These characteristics are not suitable for many contemporary electronic devices which have been miniaturized in keeping with modem trends.

In addition, after the shell is engaged with the housing, the tubular portion of the housing is prone to move longitudinally from the base portion of the housing. This is particularly true in working environments which are subject to vibration.

Moreover, due to the configuration of the distal end of the arms of the shell, leakage of electromagnetic noise may occur between the cable and the distal end. This can result in excessive electromagnetic interference (EMI).

Hence, an improved cable end connector with an EMI shell is required to overcome the disadvantages of the prior art.

SUMMARY OF THE INVENTION

A main object of the present invention is to provide a low profile cable end connector which firmly and accurately positions a terminal therein.

Another object of the present invention is to provide a cable end connector having a housing which cannot move from its correct position when the connector is subjected to vibration.

A further object of the present invention is to provide a cable end connector which provides improved EMI protection.

A still further object of the present invention is to provide a method for readily assembling a cable end connector and firmly connecting a coaxial cable to the connector.

A cable end connector according to the present invention comprises a dielectric housing, a terminal received in the housing, a unitarily formed shell, and a retainer attached to the shell for holding a coaxial cable therein.

The housing includes a tubular portion and a base portion. The tubular portion has a pair of wings. A passageway is axially defined through the tubular portion. The base portion forms a dam thereon. The terminal has a mating portion, and a tail portion perpendicular to the mating portion. The mating portion extends into the passageway for mating with a complementary connector. The tail portion is retained on the base portion for connecting with an inner conductor of the coaxial cable. The shell comprises a planar portion supporting the housing, and a trunk portion bendably connected to the planar portion and enclosing the tubular portion of the housing. The trunk portion of the shell defines a pair of undercuts to engage with the wings of the tubular portion of the housing. The trunk portion further includes a shoulder to press onto the dam of the base portion of the housing. A pair of arms extends rearwardly from the trunk portion. The arms and a portion of the retainer define a space for accommodating the tail portion of the terminal. Distal ends of the arms are bent toward each other. The retainer has a braiding crimp at an end thereof extending rearwardly beyond the arms of the trunk portion, for grounding a braiding layer of the coaxial cable.

Further objects and advantages of the present invention will become more apparent from a consideration of the drawings and the ensuing detailed description.

DETAILED DESCRIPTION OF THE INVENTION

Figure 8:
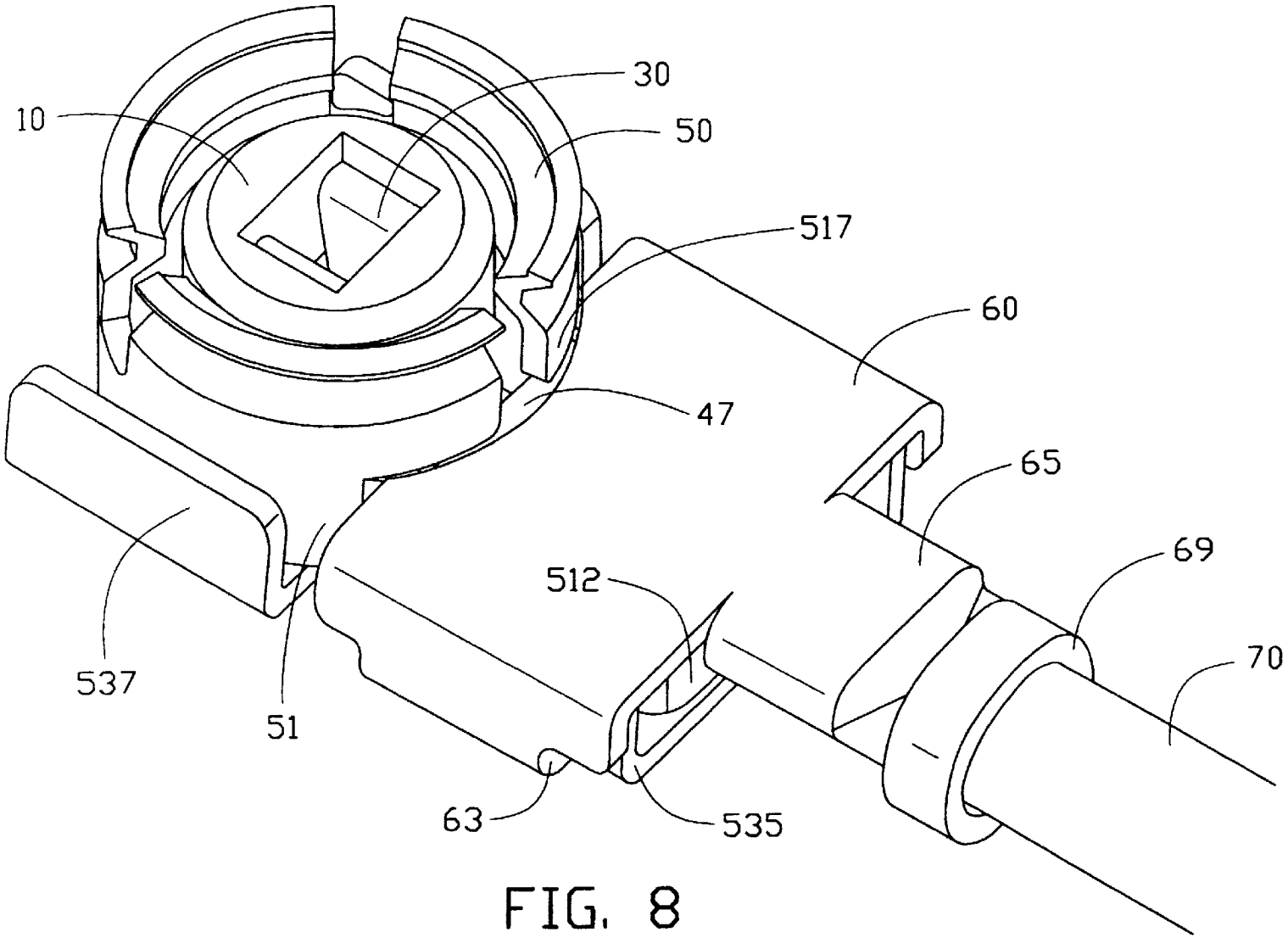
FIG. 8 is a perspective view of the cable end connector assembly.
Figure 9:
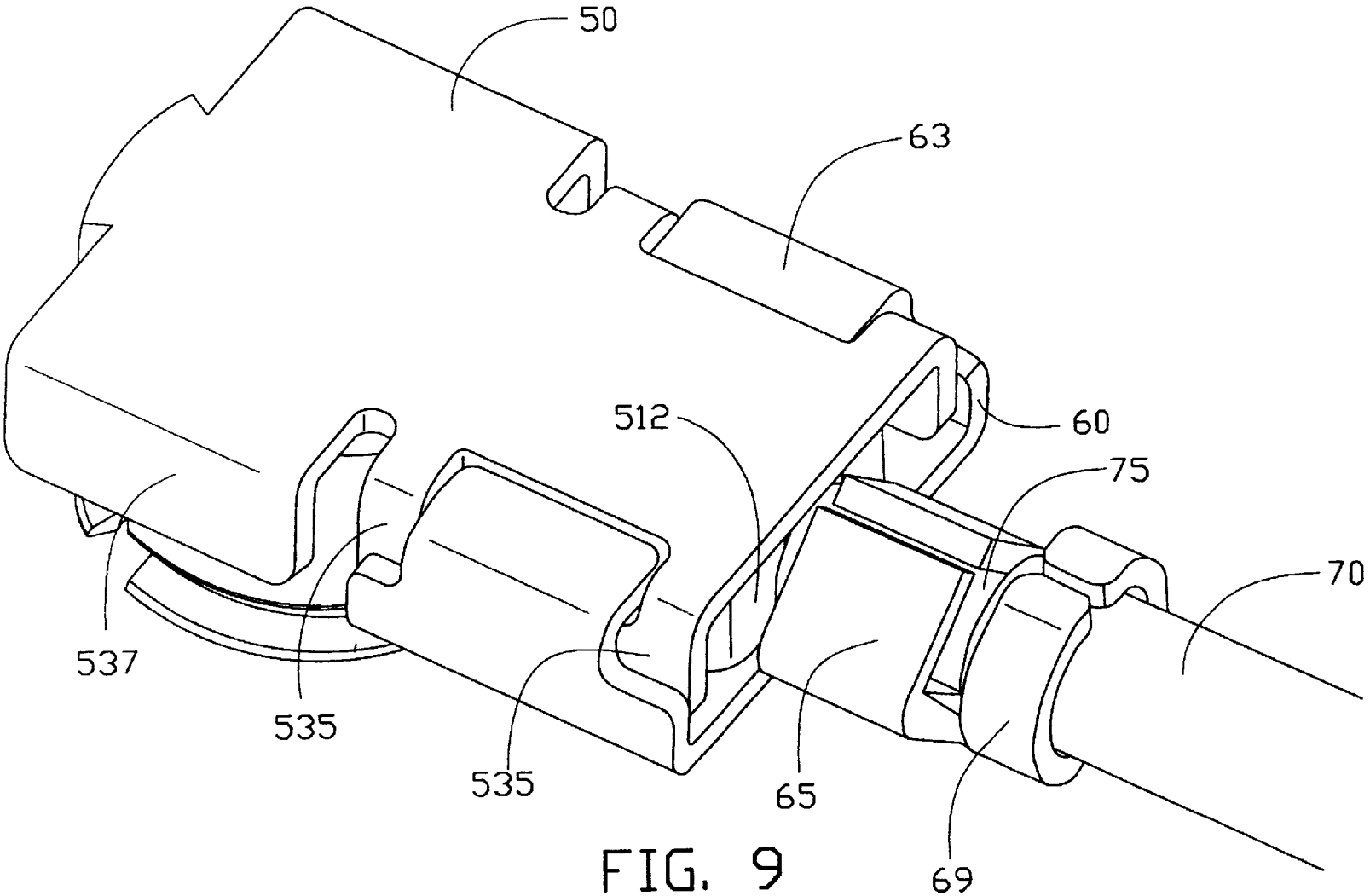
FIG. 9 is similar to FIG. 8, but viewed from another perspective.

Referring to the drawings and particularly to FIGS. 8 and 9, a cable end connector in accordance with the present invention comprises a dielectric housing 10, a terminal 30, a metallic shell 50 shielding the housing 10 and the terminal 30, and a retainer 60 for securing an end portion of a coaxial cable 70.

Figure 1:
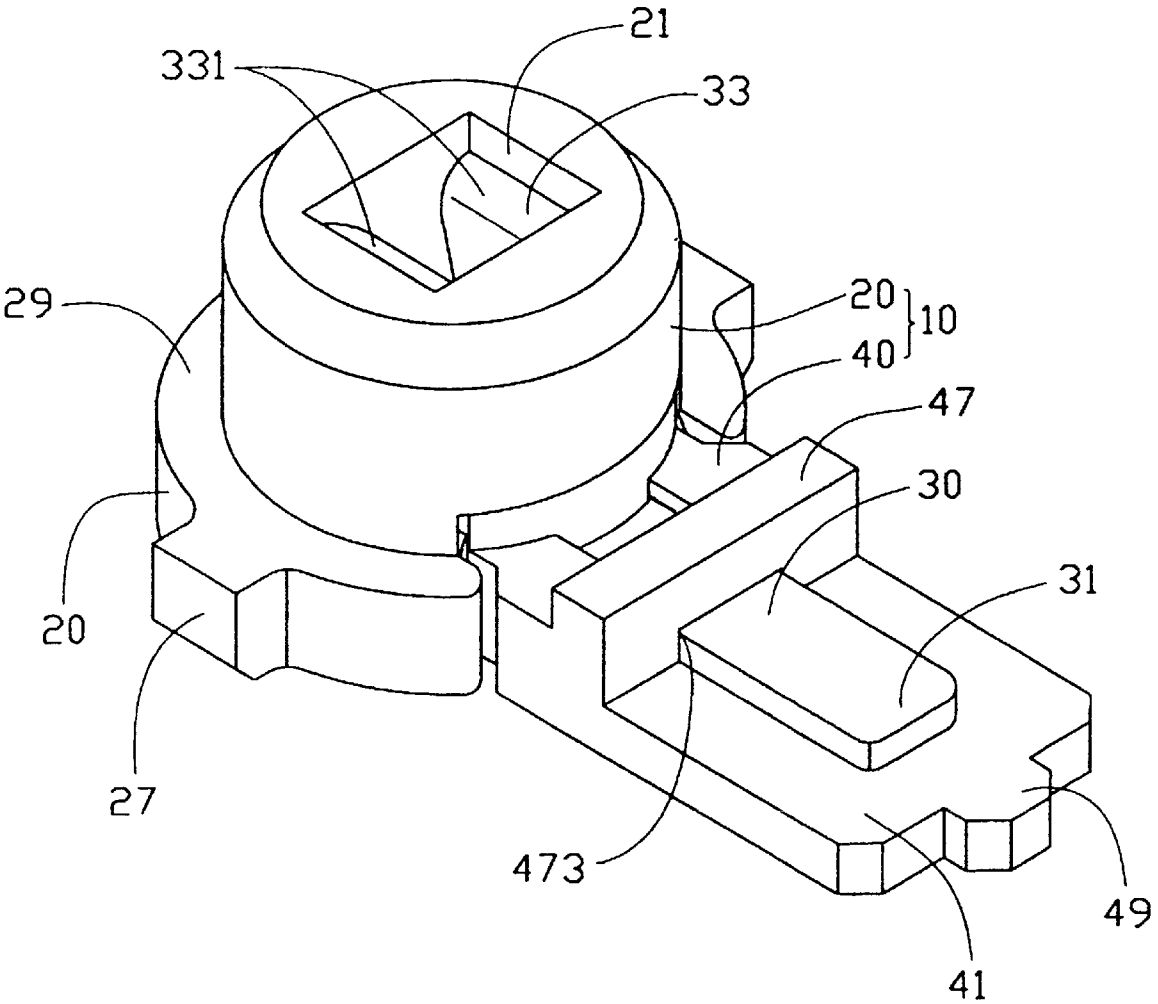
FIG. 1 is a perspective view of a terminal assembled within a housing of a cable end connector according to the present invention.

FIG. 1 shows the dielectric housing 10 with the terminal 30 installed therein. The housing 10 includes a vertical tubular portion 20 axially defining a substantially rectangular passageway 21 therein, and a base portion 40 engaged with the tubular portion 20.

The terminal 30 is L-shaped and includes a mating portion 33 and a planar tail portion 31 perpendicular to the mating portion 33. The mating portion 33 is bifurcated, and comprises a pair of beams 331 substantially leaning toward each other for mating with a complementary connector (not shown). The mating portion 33 is mounted in the passageway 21 of the tubular portion 20. The planar tail portion 31 is positioned on the base portion 40.

Figure 2:
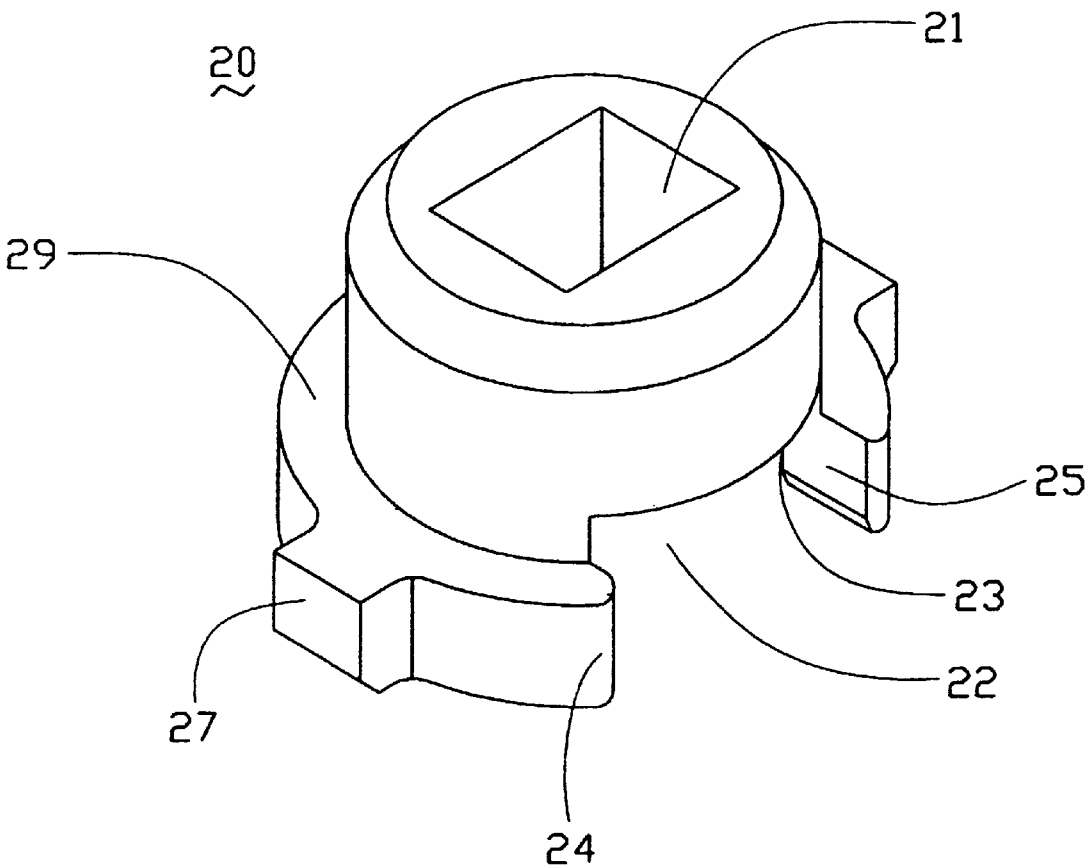
FIG. 2 is a perspective view of a tubular portion of the housing of FIG. 1.
Figure 3:
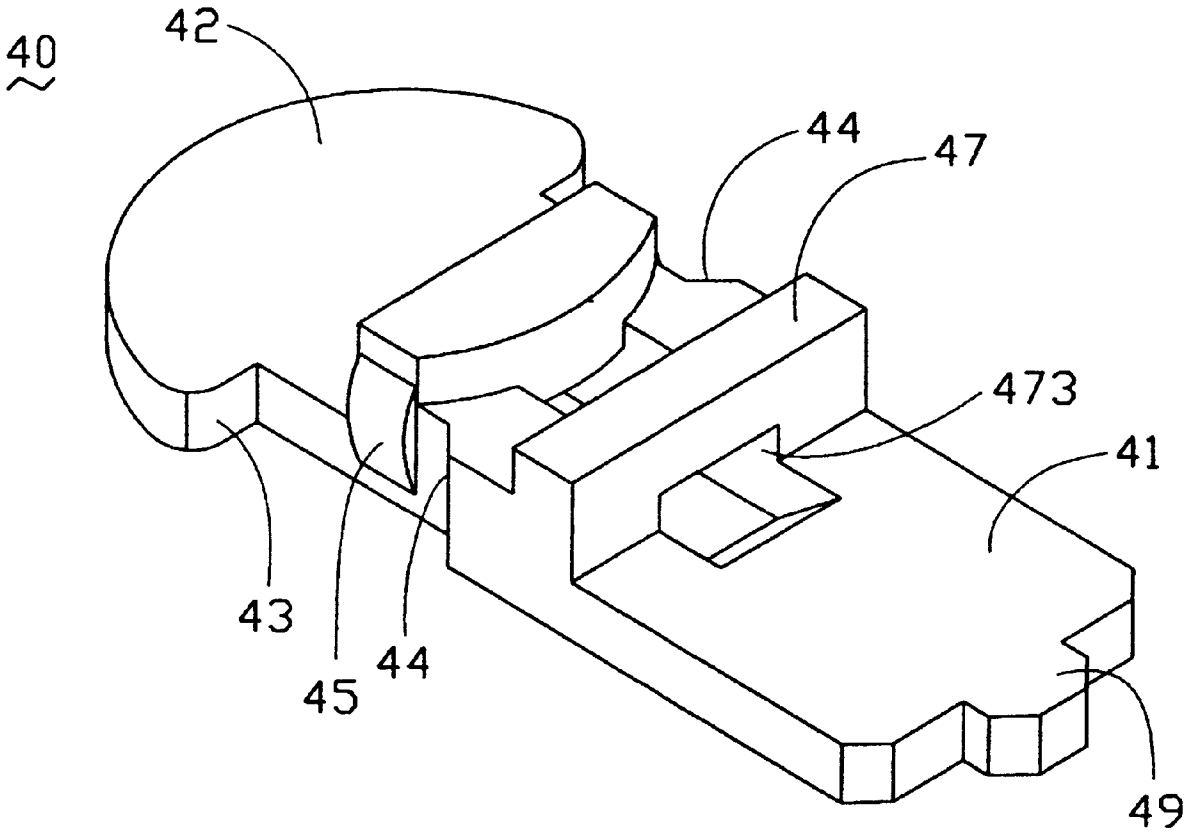
FIG. 3 is a perspective view of a base portion of the housing of FIG. 1.

FIGS. 2 and 3 respectively show the tubular portion 20 and the base portion 40 of the housing 10. The tubular portion 20 forms a step 29 around an outer periphery thereof, for supporting the shell 50. The tubular portion 20 has a pair of wings 27 for engaging with the shell 50, and a cutout 22 in communication with the passageway 21 to fittingly receive an end portion of the base portion 40 therein. Two corners 23 are formed by the inner periphery of the tubular portion 20. The tubular portion 20 also has a pair of opposing inner walls 25 separated by the cutout 22, and a pair of fillets 24 adjacent the inner walls 25.

The base portion 40 includes an engaging block 42, and a flat portion 41 extending rearwardly from the engaging block 42. The engaging block 42 has an arc-shaped outer periphery corresponding to an inner periphery of the tubular portion 20. A pair of stoppers 43 is formed between the engaging block 42 and the flat portion 41, for engaging with the comers 23 of the tubular portion 20. A pair of bumps 45 extends outwardly from opposite sides of the flat portion 41, for interferingly engaging with the inner walls 25 of the tubular portion 20 beside the cutout 22. The flat portion 41 further includes a pair of ramps 44 at opposite sides of the flat portion 41 respectively, for engaging with the fillets 24 of the tubular portion 20. A dam 47 is formed on an upper surface of the flat portion 41. A groove 473 is defined through the dam 47, for extension of the tail portion 31 of the terminal 30 therethrough. A positioning tail 49 extends outwardly from an end of the flat portion 41.

Figure 4:
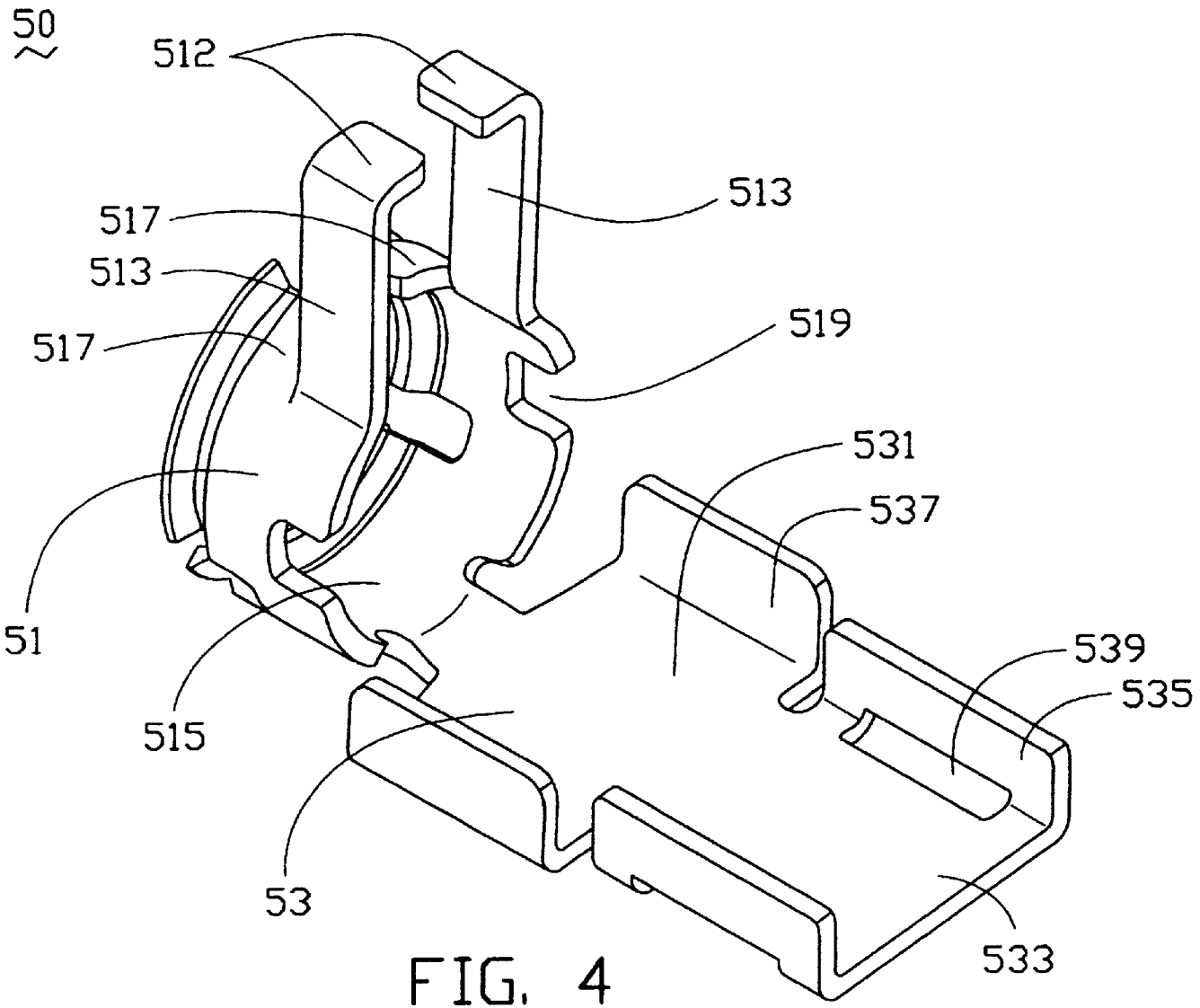
FIG. 4 is a perspective view of a shell of the cable end connector, showing a trunk portion of the shell before it is bent toward a planar portion of the shell.
Figure 5:
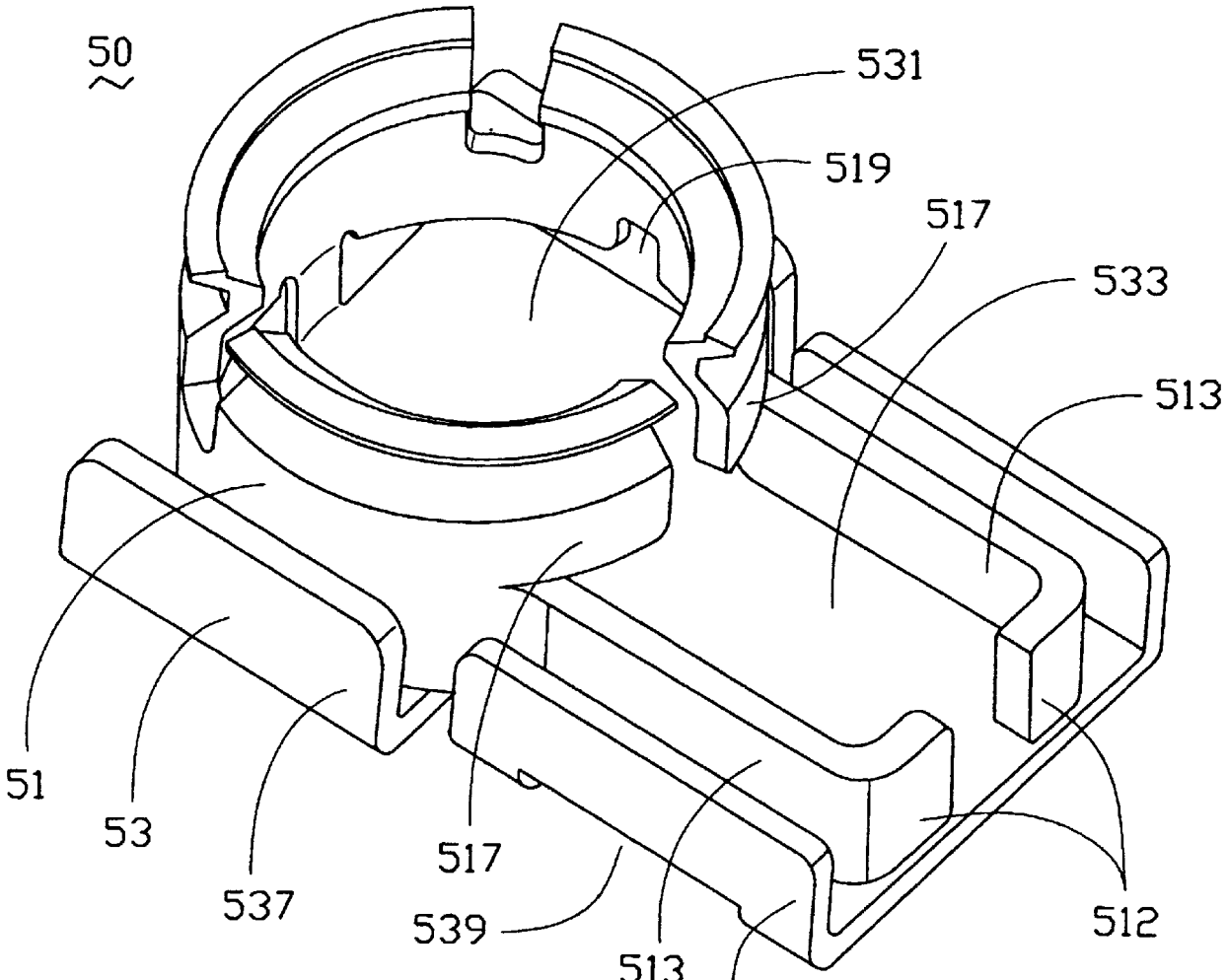
FIG. 5 is similar to FIG. 4, but showing the trunk portion bent toward and thereby mounted on the planar portion.

Referring to FIG. 4, the shell 50 is unitarily formed by stamping a metal sheet. The shell 50 comprises a cylindrical trunk portion 51, and a planar portion 53 connected to the trunk portion 51. When the trunk portion 51 is unfolded, it is substantially perpendicular to the planar portion 53. FIG. 5 shows the shell 50 with the trunk portion 51 folded and supported on the planar portion 53.

The trunk portion 51 is substantially cylindrical and has a pair of arms 513 rearwardly extending from a lower portion thereof. Each arm 513 has a distal end portion 512 bent inwardly at substantially 90?, whereby distal edges of the end portions 512 oppose each other. A space (not labeled) is defined between the opposing edges. The space has a width substantially equal to an outer diameter of an inner insulator 73 of the coaxial cable 70 (see FIG. 6). The trunk portion 51 defines a hollow portion 515 therethrough, for accommodating the tubular portion 20 of the housing 10. The trunk portion 51 forms a pair of opposing projecting shoulders 517 adjacent and above the arms 513, for pressing onto the dam 47 of the housing 10. A pair of diametrically opposite undercuts 519 is respectively defined in a bottom edge of the trunk portion 51, for engaging with the wings 27 of the housing 10.

The planar portion 53 has a front portion 531 for supporting the trunk portion 51 and the tubular portion 20 of the housing 10, and a rear portion 533 rearwardly extending from the front portion 531 for supporting the arms 513 and the base portion 40 of the housing 10. The front portion 531 forms a pair of first side walls 537 on opposite sides thereof for interferentially fitting with an outer periphery of the trunk portion 51. The rear portion 533 forms a pair of second side walls 535 on opposite sides thereof for accommodating the arms 513. A pair of slots 539 is defined in the rear portion 533, at bottom extremities of the second side walls 535 respectively.

Figure 6:
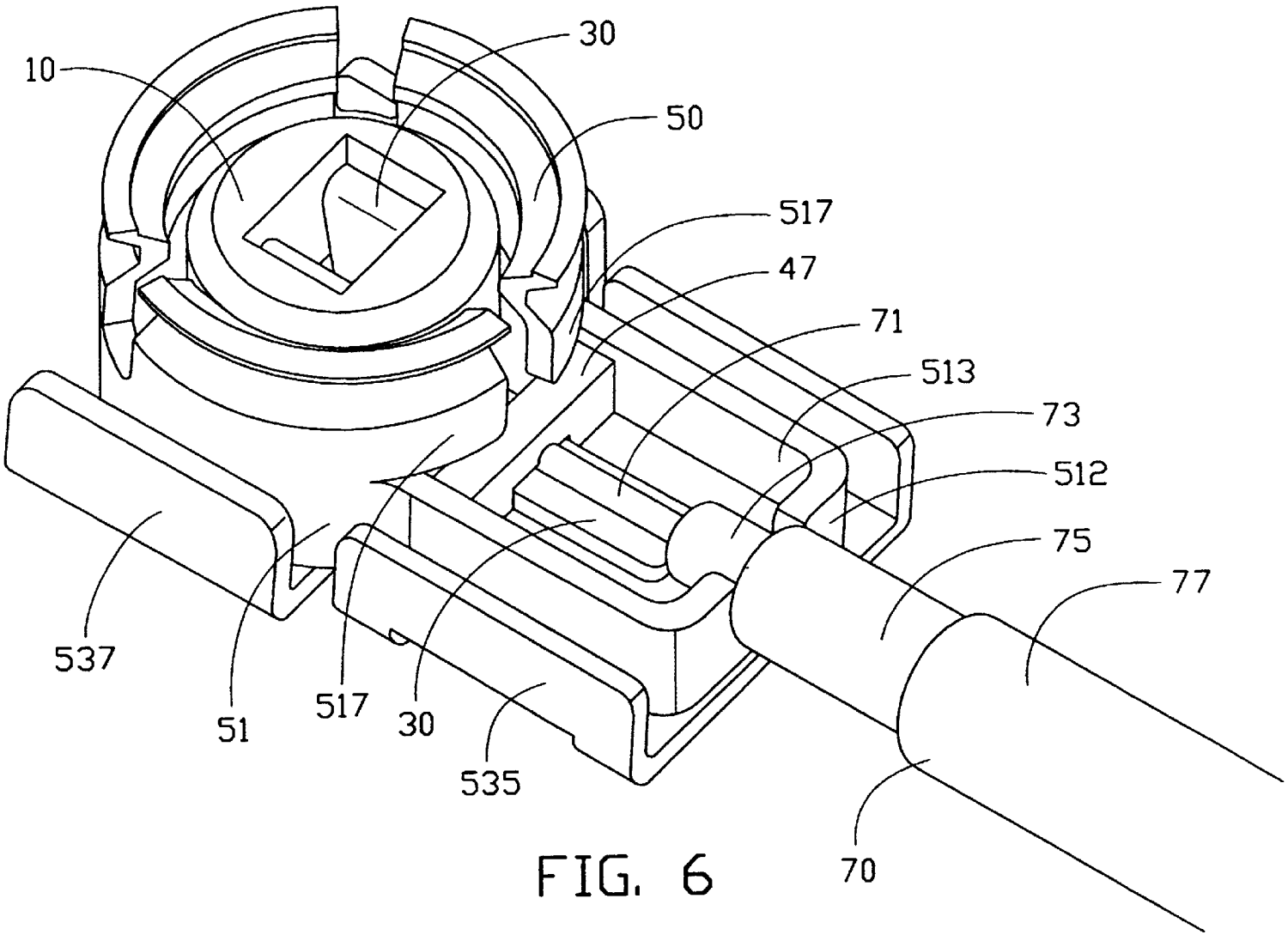
FIG. 6 is a perspective view of the shell enclosing the housing with the terminal assembled therein, and a cable connected to the terminal.

FIG. 6 shows the housing 10 assembled into the shell 50, and a coaxial cable 70 connected to the terminal 30. The coaxial cable 70 includes an inner conductor 71, a braiding layer 75, an inner insulator 73 separating the inner conductor 71 and the braiding layer 75, and an outer insulator 77 surrounding the braiding layer 75.

Figure 7:
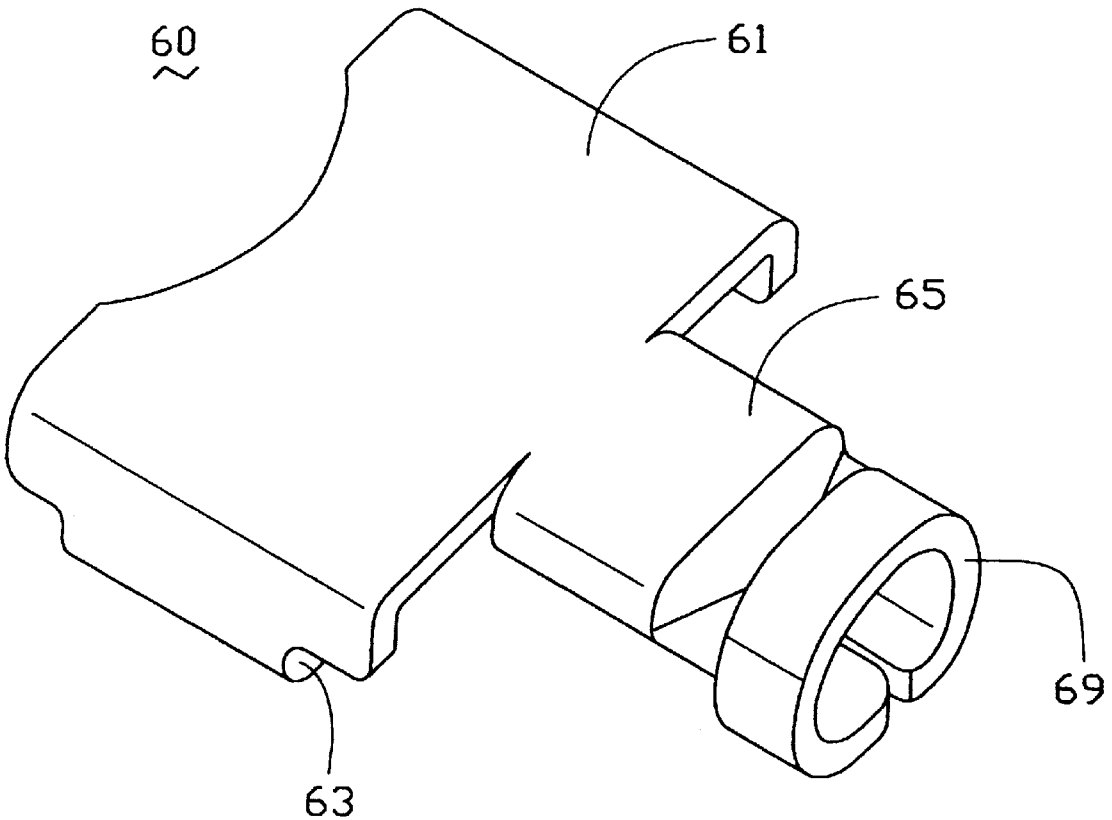
FIG. 7 is a perspective view of a retainer of the cable end connector.

Referring to FIG. 7, the retainer 60 is conductive and comprises a planar top wall 61, a braiding crimp 65 rearwardly extending from an edge of the top wall 61 for grounding the braiding layer 75 of the coaxial cable 70, and a strain relief 69 rearwardly extending from the braiding crimp 65 for securely clamping the coaxial cable 70. A pair of clips 63 respectively depends from opposite lateral sides of the top wall 61, for engaging with the slots 539 of the planar portion 53 of the shell 50.

Referring to FIGS. 8 and 9, the cable end connector assembly is assembled as follows:

(1) The tail portion 31 of the terminal 30 is inserted into the groove 473 of the base portion 40 of the housing 10, from the direction of the engaging block 42. The tail portion 31 is thus passed through the dam 47, to finally rest on the flat portion 41(see also FIGS. 1 and 3).

(2) The tubular portion 20 of the housing 10 is mounted onto the base portion 40. The engaging block 42 abuts against the inner periphery of the tubular portion 20. The stoppers 43 of the base portion 40 engage with the corners 23 of the tubular portion 20, thereby preventing the base portion 40 from moving out from the tubular portion 20. The mating portion 33 of the terminal 30 thus extends into the passageway 21 of the tubular portion 20. The beams 331 of the mating portion 33 abut against corresponding inner walls (not labeled) of the housing 10.

(3) The inner conductor 71 of the coaxial cable 70 is soldered onto the tail portion 31 of the terminal 30.

(4) The trunk portion 51 of the shell 50 is brought downwardly to enclose the tubular portion 20. The arms 513 of the shell 50 accommodate the flat portion 41 of the base portion 40 therebetween.

(5) The planar portion 53 is bent toward the trunk portion 51 until the planar portion 53 completely abuts a bottom of the housing 10. The undercuts 519 of the trunk portion 51 fittingly receive the wings 27 of the housing 10. Simultaneously, the shoulders 517 of the trunk portion 51 press onto the dam 47 of the housing 10 (see FIG. 6).

(6) The retainer 60 is attached to the shell 50. The clips 63 of the retainer 60 engage with the corresponding slots 539 of the planar portion 53, thereby fixedly retaining the arms 513 against an upper surface of the planar portion 53. The tail portion 31 of the terminal 30 is thus surrounded by both arms 513, the top wall 61 of the retainer 60, and the rear portion 533 of the shell 50. Optimal EMI protection is thereby obtained. The braiding crimp 65 of the retainer 60 extends beyond the arms 513 of the trunk portion 51, and is deformed to securely clamp the braiding layer 75 of the coaxial cable 70. Finally, the strain relief 69 is crimped to firmly engage with the outer insulator 77 of the coaxial cable 70.

Although described in the context of a particular embodiment, it will be realized that a number of modifications to these teachings may occur to one skilled in the art. Thus, while the invention has been particularly shown and described with respect to a specific embodiment thereof, it will be understood by those skilled in the art that changes in form and shape may be made therein without departing from the scope and spirit of the invention.

I claim:

1. A cable end connector assembly, comprising:

a housing including a base portion and a tubular portion engaged with the base portion, the tubular portion defining a passageway therein and further including a pair of opposite wings, the base portion having a dam formed thereon;

a terminal having a mating portion received in the passageway and a tail portion supported on the base portion;

a shell including a planar portion attached to a bottom face of the base portion of the housing, and a trunk portion connected to the planar portion and enclosing the tubular portion of the housing, the trunk portion including a pair of opposing undercuts to engagingly receive the wings of the tubular portion of the housing, a pair of arms extending beside the base portion, and a shoulder located above the arms for pressing onto the dam of the base portion;

a coaxial cable including an inner conductor electrically connected to the tail portion of the terminal, an inner insulator surrounding the inner conductor and supported by the base portion of the housing, a braiding layer enclosing the inner insulator, and an outer insulator enclosing the braiding layer; and a retainer attached to the planar portion of the shell for fixedly pressing the arms toward the planar portion, wherein the tail portion of the terminal is located in a space defined by the arms and a portion of the retainer.

wherein the retainer further includes a braiding crimp securely clamped to the braiding layer, and a strain relief for securely clamping the outer insulator of the cable;

wherein the braiding crimp extends beyond the arms of the trunk portion;

wherein the terminal comprises a bifurcated mating portion comprising a pair of beams substantially leaning toward each other for mating with a complementary connector;

wherein a pair of clips depends from opposite sides of the retainer, and wherein a pair of slots is defined in the planar portion of the shell for engagingly receiving the clips.

* * * * *